US005628359A

United States Patent [19]

Legrand et al.

[11] Patent Number: 5,628,359

[45] Date of Patent: May 13, 1997

[54] DEVICE FOR SUPPORTING A SIDEWALL OF A PLANT FOR THE CONTINUOUS TWIN-ROLL CASTING OF METAL STRIP

[75] Inventors: Hugues Legrand, Molinghem; Pierre Delassus, Bethune, both of France

[73] Assignees: Usinor Sacilor, Puteaux, France; Thyssen Stahl Aktiengesellschaft, Duisburg, Germany

[21] Appl. No.: 565,279

[22] Filed: Nov. 30, 1995

[30] Foreign Application Priority Data

Nov. 30, 1994 [FR] France ..... 94 14348

[51] Int. Cl.[6] ..... B22D 11/06

[52] U.S. Cl. ..... 164/428; 164/480

[58] Field of Search ..... 164/480, 428

[56] References Cited

U.S. PATENT DOCUMENTS 5,010,948 4/1991 Blin et al. ..... 164/480

5,437,325 8/1995 Legrand et al. .

FOREIGN PATENT DOCUMENTS 0546206 6/1993 European Pat. Off. .

0588743 3/1994 European Pat. Off. .

*Primary Examiner*—Kuang Y. Lin

*Attorney, Agent, or Firm*—Oblon, Spivak, McClelland, Maier & Neustadt, P.C.

[57] ABSTRACT

The invention relates to a device for supporting a sidewall of a plant for the continuous twin-roll casting of thin metal products, of the type including two cooled rolls having horizontal axes, and a sidewall applied against the ends of the rolls. The support device further includes a carriage which can be controllably moved in a direction parallel to the axes of the rolls, a thrust device carried by said carriage, and a mounting plate connected to the thrust device and solidly attached to the sidewall. The mounting plate includes at least two pads which can be controllably moved in a direction parallel to the axes of the rolls by devices which can apply each of the pads against an end of one of the rolls.

9 Claims, 1 Drawing Sheet

DEVICE FOR SUPPORTING A SIDEWALL OF A PLANT FOR THE CONTINUOUS TWIN-ROLL CASTING OF METAL STRIP

BACKGROUND OF THE INVENTION

Field of the Invention

The present invention relates to the continuous casting of metals. More precisely, the present invention relates to devices for the lateral containment of liquid metal in the molds of thin strip continuous casting machines, the casting space of which is bounded by the close lateral surfaces of two rolls having horizontal axes, with the rolls being vigorously cooled internally and set in counterrotation.

DISCUSSION OF THE BACKGROUND

In this type of machine for continuous casting, called "twin-roll casting", the industrial application of which to the casting of steel strip of approximately from 2 to 10 mm in thickness is currently in progress, the lateral containment of the liquid metal in the casting space defined by the rolls is provided by plates which are applied against the plane extremities of the rolls, called "ends", by a suitable device These plates are usually termed "sidewalls". Their central part intended to be in contact with the liquid metal is made of refractory material, as is, in general, their periphery which rubs frictionally against the rolls, progressively wearing them out. It is absolutely essential that these sidewalls be in contact with the rolls in as sealed a manner as possible, since infiltrations of liquid metal into their contact area would have disastrous effects on the quality of the edges of the cast strip. These would adopt a jagged shape and would be excessively brittle. They would then run the risk of separating from the rest of the strip and remain stuck to the rolls. If this sticking were to persist during one complete revolution of the rolls and if the fragments of edges were thus to penetrate into the casting space, this could give rise to serious damage to the surfaces of the rolls. At worst, these infiltrations of metal could reach as far as the outside of the machine, which would dictate stopping the casting immediately.

Such sealing defects may have many causes, among them being the following:

- distortions of the rolls and of the sidewalls, due to mechanical and thermal stresses which they are exposed to, in particular at the very start of casting when a thermal regime is imposed on them;
- progressive wear of the sidewalls or of the rolls, which is not always uniform over all their contact areas; and
- instantaneous wear of the sidewalls caused by the passage of an infiltration of solidified metal.

It has already been proposed to solve these sealing problems by causing controlled wear of the sidewalls by controlled friction of them against the rolls. Thus, the contact surfaces of the sidewalls are permanently being regenerated, matching them better to the possible variations in the shape of those parts of the rolls on which the sidewalls bear. In this regard, mention may be made of document EP-A-546,206. This document first teaches pressing the sidewalls strongly against the rotating rolls before starting the casting, so as to make them match the precise initial configuration of the ends of the rolls. Next, this pressure is relaxed slightly and then casting is started, temporarily reapplying a high pressure on the sidewalls so as to deliberately create a wear which conforms the sidewalls to the ends of the rolls. During casting, the sidewalls continue to be applied against the rolls, compensating for their wear by moving at a predetermined moderate rate. Thus, a controlled wear is caused, continuously renewing the surfaces of contact between the sidewalls and the rolls.

French Patent Application FR 94/08319 provides an improvement to this operating mode and to those which would be derived therefrom, by providing means which enable the sidewalls to be slightly deformed by modulating the pressure applied to their various areas. Thus, temporary or permanent inequalities in the forces exerted on the various parts of the sidewalls by the rolls are taken into account. Such inequalities may arise, for example, in the case of parasitic solidification of metal which has infiltrated between the sidewall and a roll, or when the two faces of the rolls, against which the sidewall is applied, are not perfectly coplanar and orthogonal to the axes of the rolls.

However, these operating modes have the drawback of imposing, on each sidewall, a frictional wear which, to be sure, can be measured by means of the rate of advance, but which cannot be controlled. The wear may prove to be unnecessarily great in the case where casting progresses without any special incident.

SUMMARY OF THE INVENTION

Accordingly, an object of the present invention is to provide the operator with a novel means of imposing, on the sidewall, a controlled wear which would not be greater than that which would be strictly required for casting to progress correctly.

For this purpose, the subject of the invention is a device for supporting a sidewall of a plant for the continuous twin-roll casting of thin metal products, of the type including two cooled rolls having horizontal axes and sidewalls applied against the ends of the rolls. The support device includes a carriage which can be controllably moved in a direction parallel to the axes of the rolls, a thrust device carried by the carriage, and a support plate connected to the thrust device and solidly fastened to the sidewall. The mounting plate includes at least two pads which can be controllably moved in a direction parallel to the axes of the rolls by devices which can apply each of the pads against an end of one of the rolls.

The invention includes equipping the means for supporting the sidewalls with at least two friction pads which can be controllably moved and each of which can bear on one of the rolls. These pads enable the loss of material by wear of the sidewall to be set accurately to a very small value when the surfaces of contact between the sidewall and the edges of the rolls are perfectly uniform. During casting, it is normally intended for the front face of each pad to be held permanently aligned with the front face of the sidewall, or very slightly set back from the latter. If the pads are aligned on the sidewall, it is these which take up the frictional force between the rolls and the sidewall, the frictional wear of which becomes theoretically zero. If they are placed slightly set back from the sidewall, it is only the latter which will rub frictionally against the rolls. It will therefore wear away, until this wear is sufficiently pronounced so that the front face of the sidewall becomes aligned with the front faces of the pads. The situation is then once again as in the previous case, and the wear is interrupted until the pads are once again placed set back from the sidewall. This setting back may be carried out continuously, with a rate of movement of the pads equal to the rate of wear which it is desired to impose on the sidewall, or else discontinuously, in which case it is their average rate of movement, calculated over a given time interval, which must be maintained equal to the desired rate of wear.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
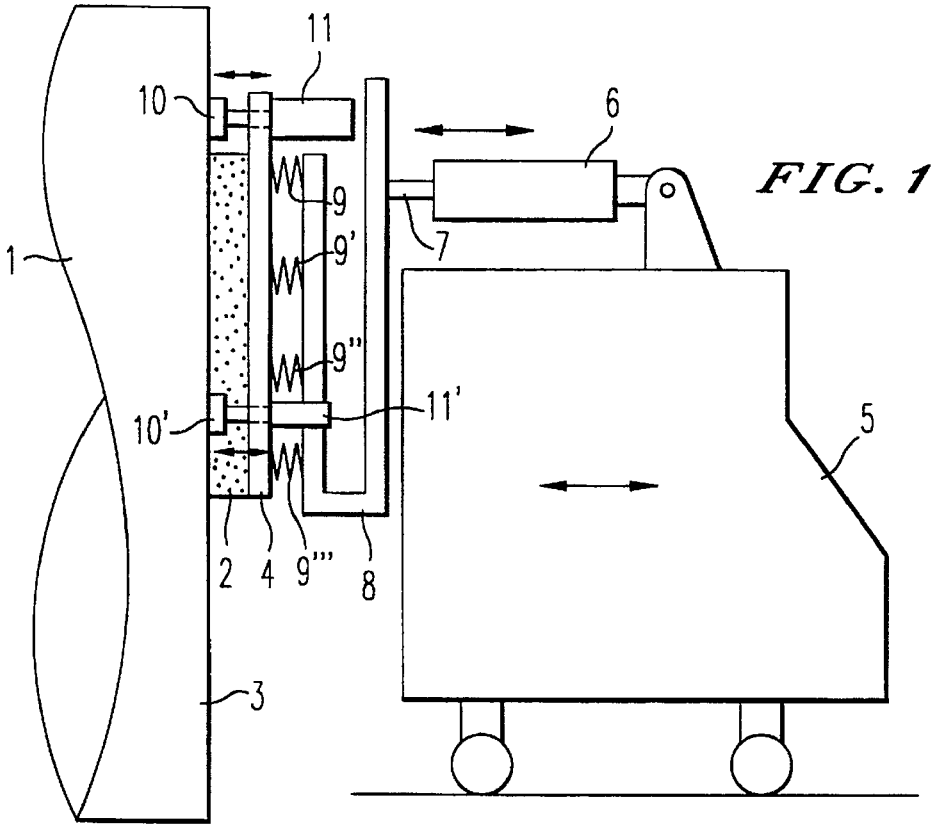
FIG. 1 diagrammatically shows end views of a device according to the invention and one of the casting rolls against which one of the sidewalls of the twin-roll casting machine is applied.

Referring now to the drawings, wherein like reference numerals designate identical or corresponding parts throughout the views, FIG. 1 represents one side of a machine for casting between two close rolls 1, 1'. The rolls 1, 1' have horizontal axes, are rotating and internally cooled, and only one of the rolls 1 is visible in FIG. 1. The other side of the machine is equipped in a similar manner. The casting space defined by the two rolls 1,1' is blocked off laterally by a sidewall 2 made of refractory material, the front face of which is applied against the ends 3 of the rolls 1, 1'. The sidewall 2 is fixed to a mounting plate 4 which is made of a material such as a metallic material. The mounting plate 4 is preferably cooled in order to prevent it from being affected by deformations of purely thermal origin.

The movements and the bearing force on the rolls 1,1' of the sidewall 2 are controlled by a unit which acts on the mounting plate 4 and which will be described in more detail. In a known manner, the unit comprises a carriage 5 which can be controllably moved in a direction parallel to the axes of the rolls 1, 1'. Mounted on this carriage 5 is a thrust device 6 such as a thrust cylinder, including a rod 7 which can be controllably moved, again in the same direction parallel to the axes of the rolls 1, 1'. In a simplified (not represented) version of the invention, this rod 7 acts directly on the mounting plate 4, and its position, conjugate with that of the carriage 5, enables the bearing force exerted by the sidewall 2 on the rolls 1, 1' to be adjusted. In an elaborate version of the invention, which deals once again with the device forming the subject of the already mentioned French Patent Application FR 94/08319, the rod 7 drives a thrust plate 8 which is itself connected to the mounting plate 4 via a set of thrust members 9, 9', 9", 9'" such as controlled springs or thrust cylinders. These members are distributed over an area whose shape corresponds to that of the sidewall 2. The function of these members is to allow a slight rearward motion of a portion of the sidewall 2 when a parasitic solidification becomes interposed between it and one of the rolls 1, 1', without thereby affecting the conditions of contact between the rest of the sidewall 2 and the rolls. Reference may be made to the text of the aforementioned French patent for more details.

Figure 2:
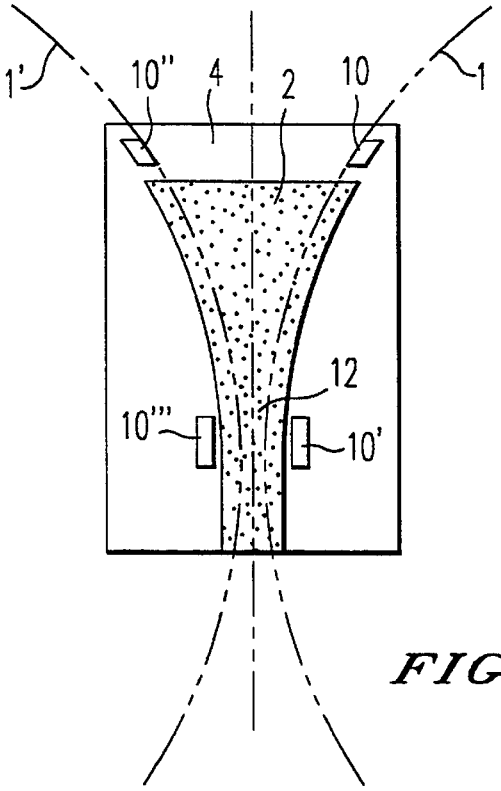
FIG. 2 diagrammatically shows the front face of a sidewall, the support of which is in accordance with the invention.

According to the invention, in the example represented in FIGS. 1 and 2, the mounting plate 4 supporting the sidewall 2 carries four pads 10, 10', 10", 10'". These pads 10, 10', 10", 10'" are each equipped with a device 11, 11', which can move them controllably, in a regular or irregular manner, in order to allow them either to end up bearing on any part of the end 3 of one of the rolls 1, 1' or to be moved away from this roll. Represented by the broken lines in FIG. 2 is the tract of the peripheries of the rolls 1, 1', so as to locate the positions of the pads 10, 10', 10", 10'", with respect to the rolls 1, 1' and to the sidewall 2. The pads 10, 10" are put into position in the upper part of the mounting plate 4 and can bear on the edges of the ends 3 of the rolls 1, 1' just above the sidewall 2 The pads 10', 10'" are put into position in the lower part of the mounting plate 4 and bear on the rolls 1, 1' alongside the sidewall 2 and near the neck 12, that is to say the area where the separation between the rolls 1,1' is the smallest.

It is clearly understood that the positions of the pads 10, 10', 10", 10'", as they have been described and represented, only constitute examples of implementation of the invention. Other positions would be conceivable and their choice depends in particular on the configuration of the mounting plate 4 The devices for moving the pads 10, 10', 10", 10'", may comprise an electrical or hydraulic actuator, for example thrust cylinders, screws, rack-type devices, etc. These pads 10, 10', 10", 10'" may, as represented, have a plane surface of contact with the ends 3 of the rolls 1, 1'. In this case, they also preferably include means (not represented) which ensure that this contact surface is lubricated, for example by injecting oil or a powder of a solid lubricant, such as boron nitride. The frictional wear both of the rolls 1, 1' and of the pads 10, 10', 10", 10'" is thus limited As a variant, these pads 10, 10', 10", 10'" may comprise a roller or a small wheel, in which case it is no longer necessary to provide a lubrication device. In addition to their lesser sensitivity to the frictional wear phenomena, these variants have the advantage, compared to the pads having a plane surface of contact with the roll 1, 1', of being less sensitive to contaminations which may be present on the ends 3 of the rolls 1, 1', because of their smaller contact surface.

The function of these pads 10, 10', 10", 10'", is, as was stated above, to limit the rate of wear of the sidewall 2 by taking up, under normal operations, most of the frictional force between the rolls 1, 1' and the sidewall 2. Thus, the frictional wear of the sidewall 2 becomes virtually zero in the absence of incidents such as the appearance of parasitic solidifications which would accelerate this wear.

As a variant, it is also possible to equip each mounting plate 4 with only two pads, each rubbing frictionally on a different roll 1, 1' and each arranged preferably in the vicinity of the upper part of the sidewall 4, for example, at the position of the pads 10, 10" in FIG. 2.

The presence of at least two pads 10, 10', 10", 10'" per roll 1, 1', conjugate with that of the thrust plate 8 and of the thrust members 9, 9', 9", 9'", makes it possible to optimize the rate of wear of the sidewall 2 over its various areas, taking into account the special events which could contribute to more pronounced wear in the vicinity of one of the rolls 1, 1' than the other. Advantage may thus continue to be taken of the possibilities of slight deformation of the sidewall 2 and of the mounting plate 4 which are related to the use of the thrust plate 8/thrust members 9, 9', 9", 9'" system. However, as was mentioned, the invention is also applicable to the case where the thrust cylinder 6 drives the mounting plate 4 directly.

Consequently, it is possible to provide a casting procedure which is as follows. Before starting casting, the front parts of the pads 10, 10', 10", 10'" are placed a few tenths of a mm set back from the front face of the sidewall 2 brought into contact with the rolls 1, 1'. Then, the rolls 1, 1' are rotated, advancing the sidewall 2 toward them by means of the thrust cylinder 6 so as to cause wear of the sidewall 2 which shapes the sidewall to the precise configuration of the ends 3 of the rolls 1, 1'. This wear is continued until the front parts of the pads 10, 10', 10", 10'" come into contact with the rolls 1, 1'.

At this moment, it is no longer possible to advance the sidewall 2 and it stops being worn. Casting then starts, after having possibly reduced the bearing force of the sidewall 2 on the rolls 1, 1'. During casting, either the pads 10, 10', 10", 10'" are left fixed, if it is desired for the sidewall 2 to undergo no wear, or they are moved rearward in a continuous or irregular manner at a controlled average rate, for example of the order of from 2 to 10 mm per hour. This progressive rearward movement enables the surface of contact between the sidewall 2 and the rolls 1, 1' to be renewed, while still keeping the wear of the sidewall 2 to a moderate value, for example, approximately that of the central part of the sidewall 2 which is in contact with the liquid metal and which, consequently, undergoes essentially chemical erosion. By virtue of the invention, a moderate wear of the sidewall 2 is controlled much more accurately than could be achieved by using just the thrust cylinder 6.

Nevertheless, if during casting sealing defects between the rolls 1, 1' and the sidewall 2 were observed, there would be the possibility of immediately moving the pads 10, 10', 10", 10'" rearward by a few tenths of a mm and of temporarily increasing the rate of advance and the bearing force of the sidewall 2 so as to ensure rapid renewal of their contact surfaces.

It may also be pointed out that the systems for lubricating the pads 10, 10" contribute to the lubrication of the interfaces between the rolls 1, 1' and the sidewall 2, since the edges of the rolls 1, 1', against which they bear, will immediately afterwards come into contact with the sidewall 2. This is favorable to a reduction in the wear of the sidewall 2.

Another variant of the invention comprises using pads 10, 10', 10", 10'" (or at least some of them) made of a self-lubricating material, such as boron nitride. The application of an external lubricant on their surface which is in contact with the roll 1, 1' is then no longer necessary. In order to compensate for the wear of the pads 10, 10', 10", 10'" thus produced, their movement devices 11, 11' are designed to be able to impose a steady movement in the direction of the roll 1, 1'. This movement has to stop as soon as the force sensors, usually associated with the closest thrust members 9, 9', 9", 9'" detect a relaxation of the reaction forces exerted by the roll 1, 1' on the sidewall 2 and its mounting plate 4, since such a relaxation is a sign that the front face of the pad 10, 10', 10", 10'" in question is no longer aligned with the front face of the sidewall 2.

The invention is, moreover, perfectly compatible with the use of sidewalls 2 on which, as is known, an oscillatory movement in the plane of the plane faces of the rolls 1, 1' may be impressed.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A casting device comprising:

first and second cooled rolls having horizontal axes;

a sidewall applied against ends of the rolls;

a carriage which can be controllably moved in a direction parallel to the axes of the rolls;

a thrust device carried by said carriage;

a mounting plate connected to said thrust device and solidly fastened to the sidewall; and at least two pads, each connected to a moving device, on said mounting plate which can be controllably moved in a direction parallel to the axes of the rolls by respective moving device which are adapted to apply each of said pads against an end of one of said rolls.

2. A device as claimed in claim 1, wherein the mounting plate is connected to the thrust device via a thrust plate and via thrust members distributed over an area of shape corresponding to that of the sidewall.

3. A device as claimed in claim 1, wherein said moving devices comprise cylinders.

4. A device as claimed in claim 1, wherein said moving devices comprise screw devices.

5. A device as claimed in claim 1, wherein said moving devices comprise rack-type devices.

6. A device as claimed in claim 1, wherein said pads include means for lubricating their face intended for coming into contact with said roll.

7. A device as claimed claim 1, wherein at least some of said pads are made of a self-lubricating material.

8. A device as claimed in claim 1, wherein said pads comprise rollers.

9. A device as claimed in claim 1, wherein said pads comprise small wheels.

* * * * *